United States Patent [19]

Hsieh

[11] Patent Number: 4,968,034

[45] Date of Patent: Nov. 6, 1990

[54] MULTI-FUNCTIONAL ELECTRONIC SELF-PROTECTION DEVICE

[76] Inventor: Webert Hsieh, Room 4, 12th Fl., #342, Fu Shin S. Road, Sec. 1, Taipei, Taiwan

[21] Appl. No.: 232,639

[22] Filed: Aug. 8, 1988

[51] Int. Cl.[5] ..... F41B 15/04

[52] U.S. Cl. ..... 273/84 ES; 231/7; 361/232

[58] Field of Search ..... 273/84 ES; 231/2, 2 E; 361/232

[56] References Cited

U.S. PATENT DOCUMENTS

| | | | |
|---|---|---|---|
| 2,208,852 | 7/1940 | Mongan | 273/84 ES |
| 2,253,315 | 8/1941 | Andrus | 273/84 ES |
| 2,561,122 | 7/1951 | Juergens | 273/84 ES |
| 3,885,733 | 5/1975 | Klebold et al. | 273/84 ES |
| 4,486,807 | 12/1984 | Yanez | 273/84 ES |

FOREIGN PATENT DOCUMENTS

| | | | |
|---|---|---|---|
| 2196728 | 5/1988 | United Kingdom | 273/84 ES |

*Primary Examiner*—Edward M. Coven
*Assistant Examiner*—Jessica J. Harrison
*Attorney, Agent, or Firm*—Lowe, Price, LeBlanc, Becker & Shur

[57] ABSTRACT

A multi-functional electronic self-protection device is disclosed. The device includes a flashlight with reflector which also mounts shock blocks. The casing includes a circuit board and booster together with a battery, and in the base thereof, a buzzer is mounted. A first switch controls the flashlight so that rotation of the lens case will turn the light on and off. A second switch controls the generation of an electric charge at the shock blocks so that when the casing is rotated and a switch depressed, a strong electrical charge whill be generated at the shock blocks. The base is also slidably mounted on the casing and by slidably displacing the base, a third switch activates the buzzer which is coupled also to the battery.

3 Claims, 7 Drawing Sheets

MULTI-FUNCTIONAL ELECTRONIC SELF-PROTECTION DEVICE

BACKGROUND OF THE INVENTION

Conventional electronic self-protection devices are innumerable and electronic shock rod is most popularly used for self-protection against evil fellows. Although conventional electronic shock rod is big in size and not convenient for carriage or application by women, however in order to make improvement, the applicant has created the present multi-functional electronic self-protection device to provide the following features:

1. The present appearance is attractive and has no protruding bottom.
2. It provides high security and is easy to operate. Electric shock control is operated by turning round the front cover to drive a conductor leaf with consequence squeezing of a control button, i.e. dual-control, which protects the user from error triggering.
3. The flashlight is easily operated by revolving control, no push-button is required.
4. Buzzer control is easily operated by means of push-and-pull system.
5. By means of female connection, assembly of parts is easy and the cost of which is reduced; labor cost can also be drastically reduced.

SUMMARY OF THE INVENTION

The present invention is to provide a multi-functional electronic self-protection device, and more particularly a device used for self-protection, which will make use of a lens arranged at the end of the front cover and a reflecting mirror arranged at the end of a cylindrical front holder with a front cover. A base casing is mounted on said cylindrical front holder with back holder and back cover respectively attached to it. By a housing to let the said component parts can be assembled to form a device, by adjusting the front cover to control the condensation of the light. Revolve the cylindrical front holder and the housing to control On/Off of the bulb. By revolving the cylindrical front holder and pressing on the button control, the electric shock is avoided and by simply drawing the back cover from the housing control an acoustic alarm starts.

DESCRIPTION OF THE PREFERRED EMBODIMENT

Figure 1:
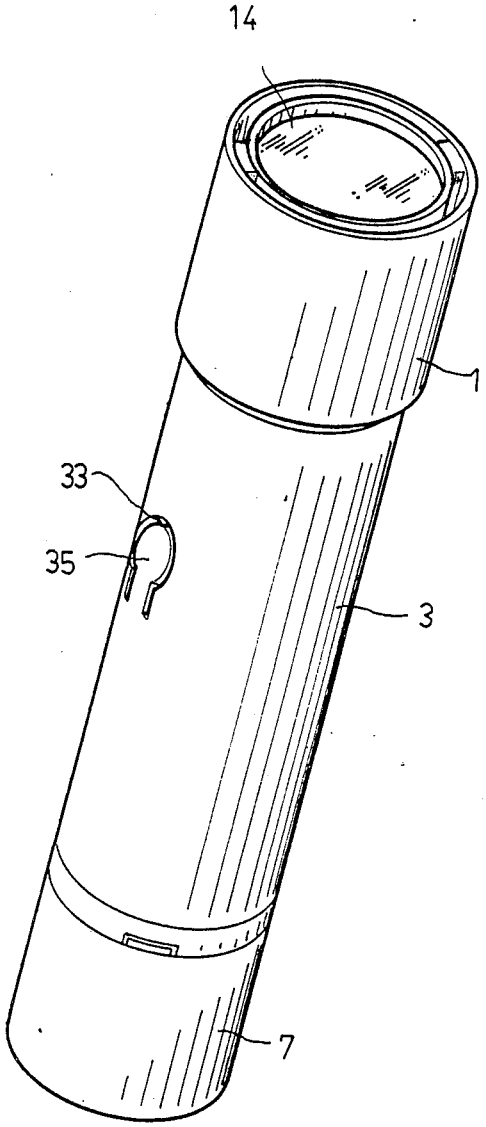
FIG. 1 is a perspective view of a self-protection device embodying the present invention.
Figure 2:
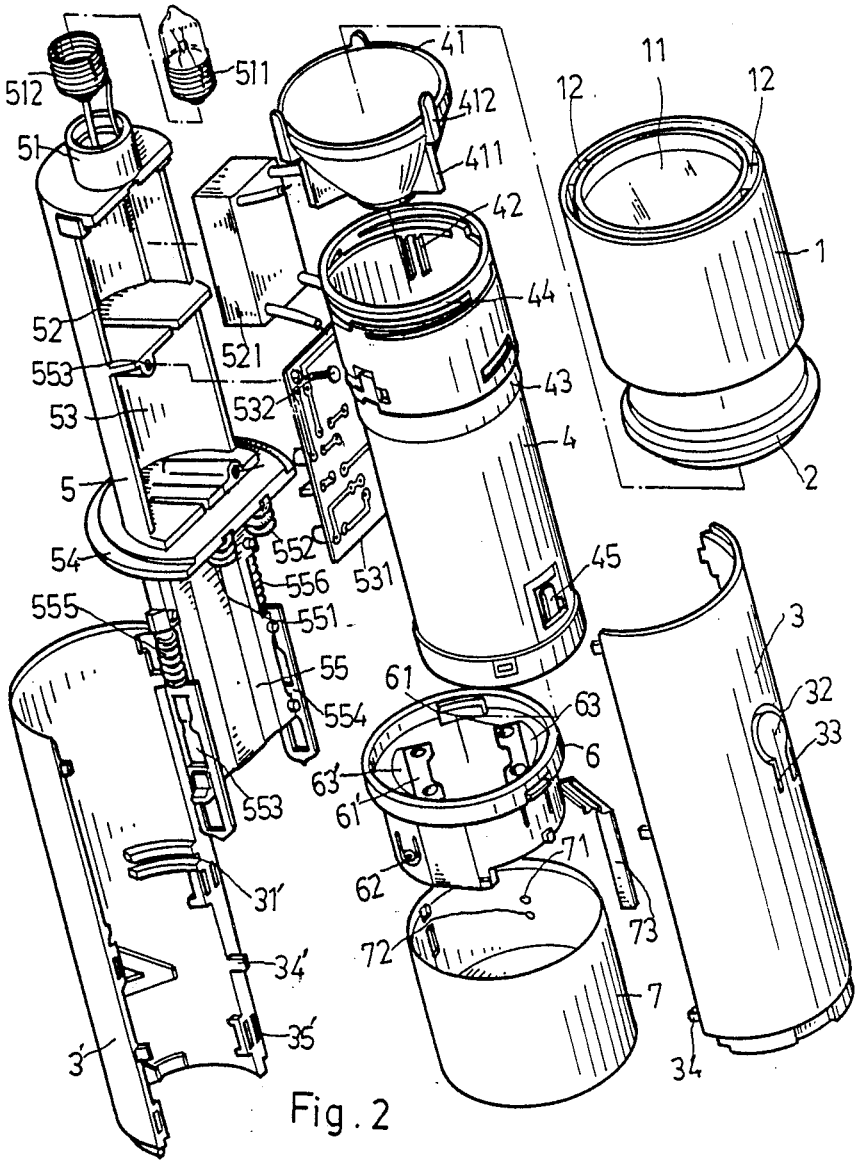
FIG. 2 is a perspective fragmentary view of the preferred embodiment.
Figure 3:
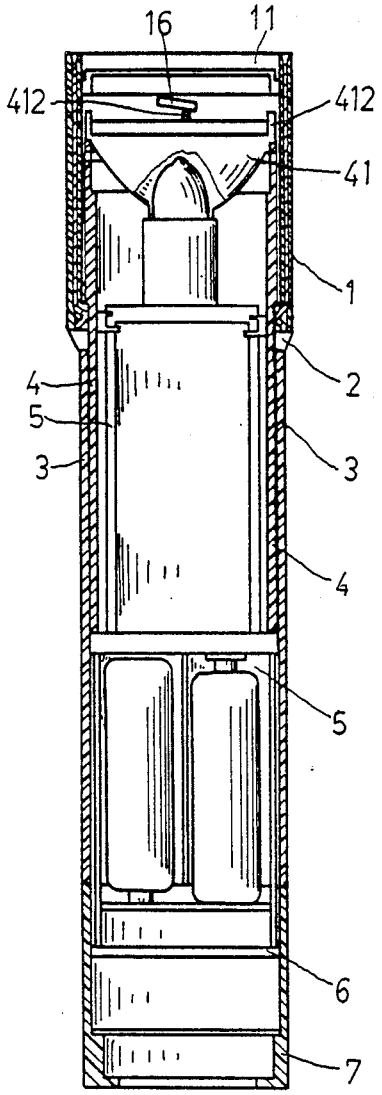
FIG. 3 is a cross-sectional view of the preferred embodiment.

The device according to the present invention, as shown in FIGS. 1,2, and 3 is mainly composed of a front cover (1), a frame edge (2), a front holder (4), a base casing (5), an upper housing (3) and a lower housing (3)', a back holder (6) and a back cover (7). The structure of the front cover (1) is as shown in FIGS. 2,3,4 and 5. The reflecting mirror (41) according to the present invention, comprises three bearing plates (411) and three protruding rods (412) with said three bearing plates (411) mounted in the track (42) at the front inner side of the cylindrical front holder (4). Said reflecting mirror (41) is then inserted into the front cover (1) through the frame edge (2) letting the reflecting mirror (41) and the front end of the cylindrical front holder (4) be allocated inside the front cover (1) and letting the frame edge (2) be arranged between the front cover (1) and the locking channel (43) of the cylindrical front holder (4). Said cylindrical front holder (4) comprises at its front edge an elastic element (44) made of plastic material, having a hollow body for allocation of said base casing (5). Said base casing (5) comprises a lamp socket (51) at the front end for allocation of a lamp holder (512) and a bulb (511) and two troughs (52) and (53). Trough (52) is arranged for allocation of booster coil (521) while trough (53) is for allocation of a booster circuit board (531). The base casing (5) comprises a ring plate (54) for allocation of the base casing (5) with the upper housing (3) and the lower housing (3)' by inserting the ring plate (54) into the locating channel (31)'. Base casing (5) also comprises a battery holder (55) for allocation of battery. The battery holder (55) itself comprises of two springs. Spring (551) and (552) for respective connection of the positive and the negative end of the battery to the circuit. Two conductor rods (553) and (554) are arranged bilaterally with springs (553) and (554) firmly attached to make them (conductor rods 553 or 554) flexible. The back holder (6) according to the present invention, is made up of two conductor plates (61) and (61)' for connection to the battery and an elastic locking edge (62) to match with the hole (71) or (72) for allocation of the back holder (6) with the back cover (7).

Figure 4:
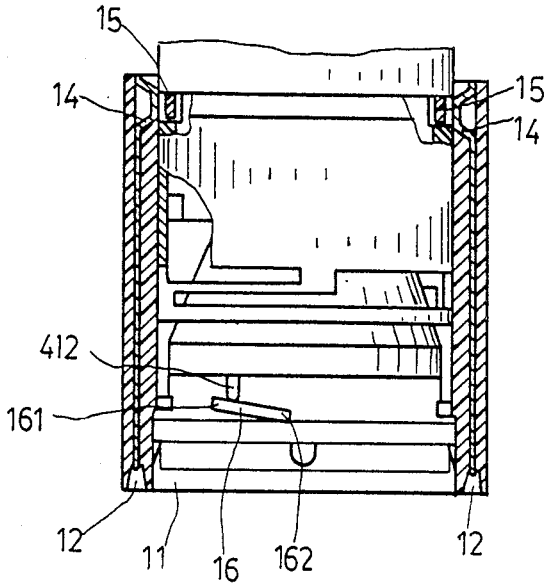
FIG. 4 is a sectional view of the front cover of the preferred embodiment.
Figure 5:
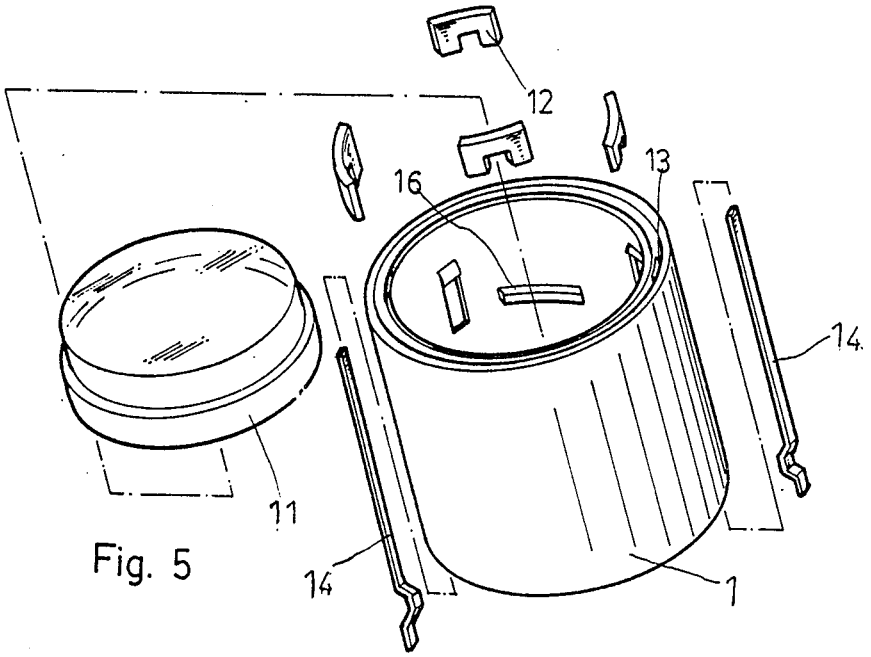
FIG. 5 is a fragmentary view of the front cover of the preferred embodiment.
Figure 6:
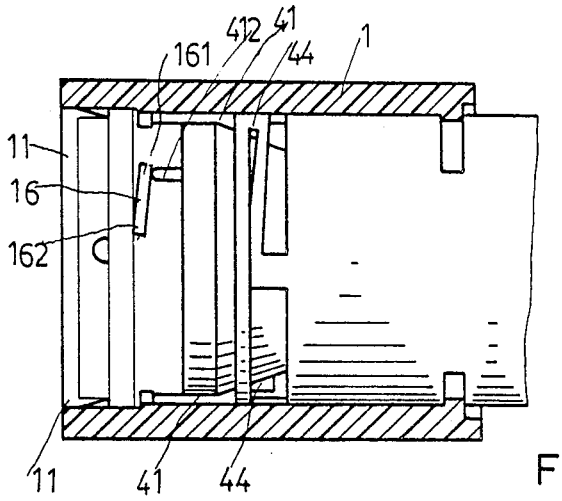
FIG. 6 is another sectional view of the front cover of the preferred embodiment. (1)
Figure 7:
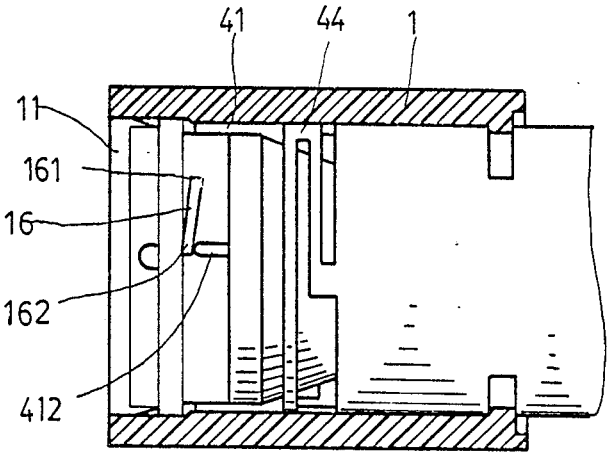
FIG. 7 is yet a further sectional view of the front cover of the preferred embodiment. (2)

Please refer to the sectional view and the fragmentary view of the front cover in FIG. 4 and FIG. 5. A lens (11) is mounted on the front edge cover (1) with shock blocks (12) connected at the circumference at a proper interval, in the present preferred embodiment, three shcok blocks are arranged. Each shock block (12) is mounted in a groove (13) with a conductor rod (14) arranged thereto, said conductor rods (14) are turned on by means of contact plates (15) while revolving, the contact plates (15) are connected to the booster coil (521) by means of electric wires. Please refer to FIG. 6 and FIG. 7 for the arrangment of the elastic element (44) and the reflecting mirror (41) of the cylindrical front holder (4) and the sloping block (16). The protruding rod (412) pushes the reflecting mirror (41) backwards when it is turned to the lowest position at the sloping block (16) of the extreme inner side (61). When the protruding rod (412) of the reflecting mirror (41) reaches the peak point (162), the reflecting mirror (41) is forced to move forward by means of the elastic element (44), thereby controlling the condensation or dispersion of the light from the bulb (511).

Figure 8:
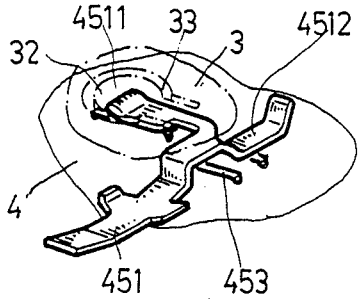
FIG. 8 illustrates one motion of a switching element of the preferred embodiment. (1)
Figure 9:
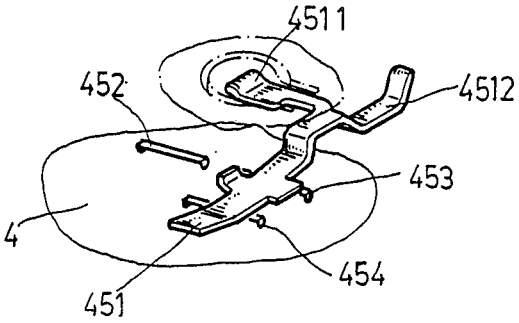
FIG. 9 illustrates another motion of the switching element of the preferred embodiment. (2)

The housing (3), according to the present invention, comprises a built-in press-button (32) separated from it by a groove channel (33), thereby making the application of the press button (32) difficult to fail. The press button (32) is directed to the switching element (45) of the cylindrical front holder (4)'. The structure of the switching element (45) is shown in FIG. 8 and FIG. 9. When the housing (3) and (3)' are turned to rotate the spring leaf (451) of the switching element (45) is driven to move, letting the upper contact plate (452) and the lower right contact plate (453) get in contact with the upper contact block (4511). The lower contact block (4512) of the spring leaf (451) is for electricity conducting and to let the connected bulb (511) be turned on (as shown in FIGS. 2 and 3). When turning to another angle, the arc-shaped portion (141) of the shock rod (14) of the front cover (1) is driven to contact with the contact block (15) and the spring plate (451) then is driven to span over the lower left contact plate (452) and the lower right contact plate (453). Therefore, by pressing on the press button (32), the booster circuit (531) is turned on to produce high voltage electric shock.

Figure 10:
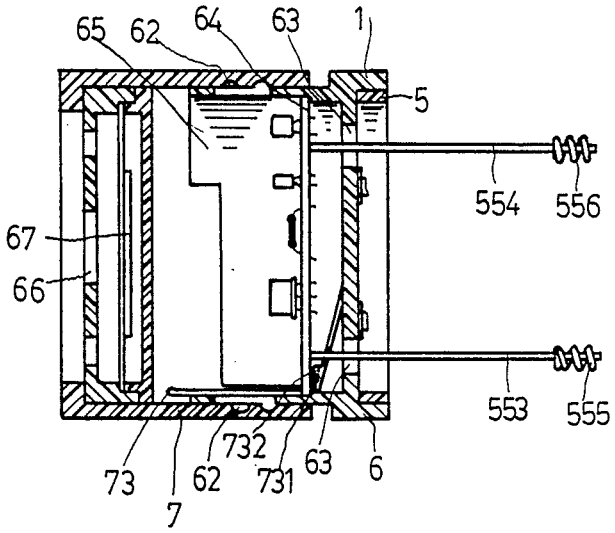
FIG. 10 is a sectional view of the back holder and the back cover of the preferred embodiment. (1)
Figure 11:
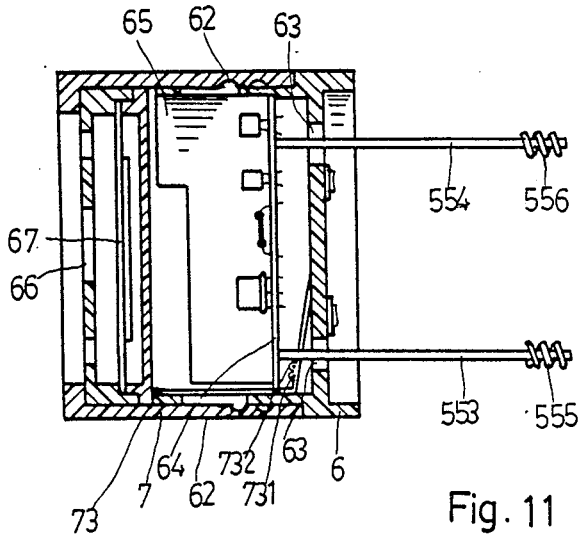
FIG. 11 is another sectional view of the back holder and the back cover of the preferred embodiment. (2)

Please refer to FIGS. 2, 10 and 11 for the structure of the back holder (6) and the back cover (7). The conductor rods (553 and 554) are arranged to penetrate through the holes (63 and 63') and directly welded to the negative and positive end of the circuit board (64) at the trough (65) of the back holder (6). the circuit board (64) is to provide a buzzer circuit for alarm. It comprises of two conductor plates (not shown in the drawings). When the back holder (6) and the back cover (7) are turned to their allocation as allocated at the slot (71). They are forced to press on the spring leaf (73) letting two control noses (731) and (732) of the spring leaf (73) move away from the circuit board. When the back cover (7) is drawn from the housing, the two control noses (731) and (732) of the spring leaf (73) are forced to contact the copper foil for electricity conduction and to let the buzzer circuit produce acoustic alarm. The buzzer (67) buzzes through the hole (66) of the speaker.

The booster circuit board (531), according to the present invention, is attached to the base casing (5) by a bolt (532) through the bolt hole (553)'. The other parts are allocated by means of hook joint. For instance, each housings (3) and (3)' comprises of respective retainer hooks (34) and retaining grooves (35)' for easy assembly. In the present invention, the condensation of the light from the bulb (511) is controlled by revolving the front cover. The electric shock is controlled also by revolving the cylindrical front holder (4) prior to pressing the press-button (32). The acoustic alarm is controlled by drawing the back cover (7) from the housing. Through the described arrangement, the present invention could be controlled to provide electric shock for self-protection, acoustic alarm for help and the respective long-range and short-range lightening for illumination.

I claim:

1. A multi-functional self-protection device comprising:

a cylindrical front cover, a lens mounted in the front end of said cover, a plurality of shock blocks mounted on the front of said cover surrounding said lens, the end of said cover opposite said lens defining a frame edge;

a cylindrical front holder having a channel receiving the frame edge, a first switch means, and a reflecting mirror mounted in said front holder;

a cylindrical base casing, a lamp socket and lamp mounted at the front end of said base casing, a booster coil and a circuit board mounted in the central portion of said base casing and battery means mounted at the end of said casing opposite said lamp socket, said base casing being received in said holder with said lamp socket and lamp received in said reflecting mirror;

means coupled to said reflecting mirror for controlling the dispersion of light from said lamp when said lamp is energized;

a back holder and outside casing surrounding the sides and rear of said base casing said outside casing mounting a second switch means, said first switch means being coupled between said battery means and lamp socket for lighting said lamp, said second switch means coupled between said battery means, circuit board, booster coil and shock blocks for providing an electric charge to said blocks; and buzzer means and third switch means mounted in said back holder said third switch means coupled between said battery means and buzzer means for activating said buzzer.

2. The device of claim 1 wherein said outside casing is rotatably mounted on said base casing and said second switch means include a button and means to send an electric charge to said blocks responsive to rotation of said outside casing a predetermined distance and depression of said button.

3. The device of claim 1 wherein said back holder is axially slidably mounted on said base casing and said third switch means includes means for activating said buzzer responsive to axially slidable displacement of said back holder relative to said base casing.

* * * * *